US011603771B2

(12) United States Patent
Hwang et al.

(10) Patent No.: US 11,603,771 B2
(45) Date of Patent: Mar. 14, 2023

(54) COMPRESSOR CLEANING APPARATUS AND METHOD, AND GAS TURBINE INCLUDING SAME APPARATUS

(71) Applicant: DOOSAN ENERBILITY CO., LTD, Changwon-si (KR)

(72) Inventors: Kyu Sic Hwang, Changwon (KR); Young Jin Jung, Pyeongtaek (KR); Young Seok Heo, Changwon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/372,585

(22) Filed: Jul. 12, 2021

(65) Prior Publication Data

US 2022/0074316 A1 Mar. 10, 2022

(30) Foreign Application Priority Data

Sep. 10, 2020 (KR) ..... 10-2020- 0116172

(51) Int. Cl.
*F01D 25/00* (2006.01)
*B08B 3/02* (2006.01)

(52) U.S. Cl.
CPC ..... *F01D 25/002* (2013.01); *B08B 3/022* (2013.01); *B08B 2203/007* (2013.01); *B08B 2230/01* (2013.01); *F05D 2220/32* (2013.01)

(58) Field of Classification Search
CPC ..... F01D 25/002
See application file for complete search history.

(56) References Cited

U.S. PATENT DOCUMENTS

| | | | | |
|---|---|---|---|---|
| 9,675,984 | B1 * | 6/2017 | Sotelo | A61L 2/22 |
| 2006/0048796 | A1 * | 3/2006 | Asplund | B08B 3/02 134/21 |
| 2015/0198059 | A1 | 7/2015 | Scipio | |

FOREIGN PATENT DOCUMENTS

| | | | |
|---|---|---|---|
| EP | 1908928 | A2 | 4/2008 |
| JP | 2001214755 | A | 8/2001 |
| JP | 2015021500 | A | 2/2015 |
| JP | 2015110945 | A | 6/2015 |
| KR | 20060119696 | A | 11/2006 |
| KR | 101635916 | B1 | 7/2016 |
| KR | 1020160097248 | A | 8/2016 |
| KR | 101991134 | B1 | 6/2019 |
| KR | 1020200058786 | A | 5/2020 |

OTHER PUBLICATIONS

KR OA dated Dec. 10, 2021.
KR Decision to Grant dated Jan. 28, 2022.

* cited by examiner

*Primary Examiner* — Jason Y Ko
(74) *Attorney, Agent, or Firm* — Harvest IP Law LLP

(57) ABSTRACT

A compressor cleaning apparatus to clean a compressor of a gas turbine is provided. The compressor cleaning apparatus includes a nozzle configured to inject a cleaning fluid into an interior of a compressor, a fluid supply tube connected to the nozzle to supply the cleaning fluid to the nozzle, a first cleaning fluid supply connected to the fluid supply tube to supply a first cleaning fluid, and a second cleaning fluid supply connected to the fluid supply tube to supply a second cleaning fluid having a temperature higher than that of the first cleaning fluid.

20 Claims, 3 Drawing Sheets

COMPRESSOR CLEANING APPARATUS AND METHOD, AND GAS TURBINE INCLUDING SAME APPARATUS

CROSS REFERENCE TO RELATED APPLICATION

This application claims priority to Korean Patent Application No. 10-2020-0116172, filed on Sep. 10, 2020, the disclosure of which is incorporated herein by reference in its entirety.

BACKGROUND

1. Field

Apparatuses and methods consistent with exemplary embodiments relate to a compressor cleaning apparatus and method, and a gas turbine including the compressor cleaning apparatus.

2. Description of the Related Art

A gas turbine is a combustion engine in which a mixture of air compressed by a compressor and fuel is combusted to produce a high temperature gas that drives a turbine. The gas turbine is used to drive electric generators, aircraft, ships, trains, or the like.

The gas turbine includes a compressor, a combustor, and a turbine. The compressor serves to intake external air, compress the air, and transfer the compressed air to the combustor. The compressed air compressed by the compressor has a high temperature and a high pressure. The combustor serves to mix compressed air compressed by the compressor and fuel and combust the mixture of compressed air and fuel to produce combustion gas discharged to the turbine. The combustion gas flow through turbine vanes and turbine blades to produce rotary power, which in turn rotates a rotor of a turbine.

Because the compressor receives external air, dust and the like may adhere to compressor vanes and compressor blades, which may reduce the operation efficiency of the compressor. Therefore, the compressor needs to be cleaned periodically. However, in some situations, such as cold weather, there is a problem in that icing may occur on a surface of the compressor if cleaning water is sprayed on the compressor in a cold weather environment below 4° C.

SUMMARY

Aspects of one or more exemplary embodiments provide a compressor cleaning apparatus and method capable of stably cleaning a compressor in a cold weather condition, and a gas turbine including the compressor cleaning apparatus.

Additional aspects will be set forth in part in the description which follows and, in part, will become apparent from the description, or may be learned by practice of the exemplary embodiments.

According to an aspect of an exemplary embodiment, there is provided a compressor cleaning apparatus including: a nozzle configured to inject a cleaning fluid into an interior of a compressor; a fluid supply tube connected to the nozzle to supply the cleaning fluid to the nozzle; a first cleaning fluid supply connected to the fluid supply tube to supply a first cleaning fluid; and a second cleaning fluid supply connected to the fluid supply tube to supply a second cleaning fluid having a temperature higher than that of the first cleaning fluid.

The first cleaning fluid may include water and the second cleaning fluid may include steam.

The temperature of the first cleaning fluid may be at room temperature, and the temperature of the second cleaning fluid may be 200° C. to 400° C.

The second cleaning fluid supply may include a steam generator configured to generate steam, a steam storage configured to store the steam generated by the steam generator, a steam control valve configured to control a connection of the steam storage and the fluid supply tube, and a drain valve configured to discharge condensed water generated in the steam storage.

A hot air supply may be connected to the fluid supply tube to supply hot air to the nozzle.

The second cleaning fluid supply may further include an antifreeze supply connected to a steam supply line to supply an antifreeze agent that lowers a freezing point of water to the steam.

A heating member may be provided to the fluid supply tube to control a temperature of the fluid supply tube.

According to an aspect of another exemplary embodiment, there is provided a gas turbine may including: a compressor configured to compress air introduced from an outside; a combustor configured to mix the air compressed by the compressor with fuel and combust an air-fuel mixture; a turbine having a plurality of turbine blades configured to be rotated by the combustion gas discharged from the combustor; and a compressor cleaning apparatus configured to inject a cleaning fluid to compressor blades to clean the compressor, the compressor cleaning apparatus including: a nozzle injecting the cleaning fluid into an interior of the compressor; a fluid supply tube connected to the nozzle to supply the cleaning fluid to the nozzle; a first cleaning fluid supply connected to the fluid supply tube to supply a first cleaning fluid; and a second cleaning fluid supply connected to the fluid supply tube to supply a second cleaning fluid having a temperature higher than that of the first cleaning fluid.

The first cleaning fluid may include water and the second cleaning fluid may include steam.

The temperature of the first cleaning fluid may be at room temperature, and the temperature of the second cleaning fluid may be 200° C. to 400° C.

The second cleaning fluid supply may include a steam generator configured to generate steam, a steam storage configured to store the steam generated by the steam generator, a steam control valve configured to control a connection of the steam storage and the fluid supply tube, and a drain valve configured to discharge a condensed water generated in the steam storage.

A hot air supply may be connected to the fluid supply tube to supply hot air to the nozzle.

The second cleaning fluid supply may further include an antifreeze supply connected to a steam supply line to supply an antifreeze agent that lowers a freezing point of water to the steam.

According to an aspect of another exemplary embodiment, there is provided a method of cleaning compressor blades of a gas turbine using a compressor cleaning apparatus, the method including: transferring steam generated by a steam generator to a steam storage; discharging condensed water by opening a drain valve connected to the steam storage until a temperature difference between the steam generator and the steam storage is within a preset range;

performing a cleaning including closing the drain valve and opening a steam control valve to supply steam to a nozzle and to allow steam to be injected toward the compressor rotating at a first speed; and drying the compressor by rotating the compressor at a second speed faster than the first speed.

In the performing the cleaning, the steam may be injected while the compressor is rotated at 2 rpm to 5 rpm.

The performing the cleaning may include injecting steam and filling the steam storage with steam, wherein the injecting steam and the filling steam are alternately repeated performed.

In the performing the cleaning, the heated air may be injected while an inclination of a guide vane mounted on an inlet side of the compressor is changed to adjust a flow rate of air introduced into the compressor.

In the drying, hot air may be injected through a hot air supply connected to the nozzle.

In the drying, the compressor may be rotated after an antifreeze agent for that lowers a freezing point of water is supplied with the steam.

According to one or more exemplary embodiments, the compressor cleaning apparatus includes the first and second fluid supply sections supplying different cleaning fluids with different temperatures so that different cleaning fluids can be supplied depending on external environments, thereby preventing icing from occurring on the compressor.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
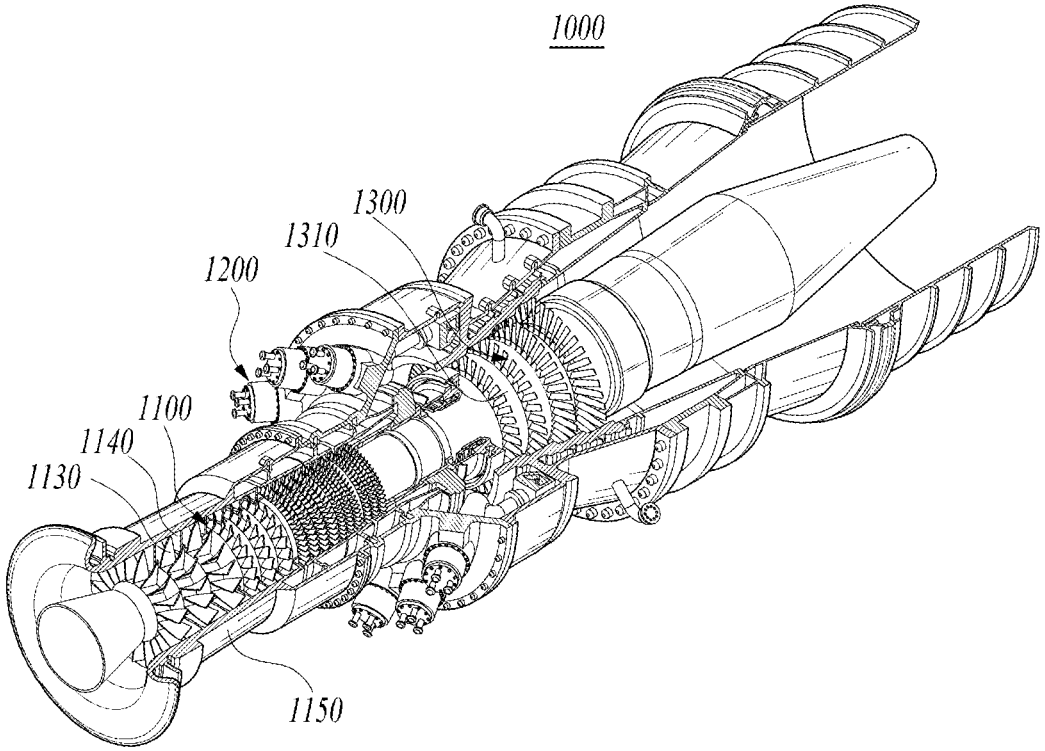
FIG. 1 is a view illustrating an interior of a gas turbine according to a first exemplary embodiment.

Various modifications and various embodiments will be described in detail with reference to the accompanying drawings. However, it should be noted that various embodiments are not limiting the scope of the disclosure to the specific embodiment, and they should be interpreted to include all modifications, equivalents, or substitutions of the embodiments included within the spirit and scope disclosed herein.

Terms used herein are used to merely describe specific embodiments, and are not intended to limit the scope of the disclosure. As used herein, an element expressed as a singular form includes a plurality of elements, unless the context clearly indicates otherwise. Further, it will be understood that the term "comprising" or "including" specifies the presence of stated features, numbers, steps, operations, elements, parts, or combinations thereof, but does not preclude the presence or addition of one or more other features, numbers, steps, operations, elements, parts, or combinations thereof.

Hereinafter, exemplary embodiments will be described in detail with reference to the accompanying drawings. It is noted that like reference numerals refer to like parts throughout the various figures and exemplary embodiments. In certain embodiments, a detailed description of known functions and configurations that may obscure the gist of the present disclosure will be omitted. For the same reason, some of the elements in the drawings are exaggerated, omitted, or schematically illustrated.

Hereinafter, a gas turbine according to a first exemplary embodiment will be described with reference to the accompanying drawings.

Figure 2:
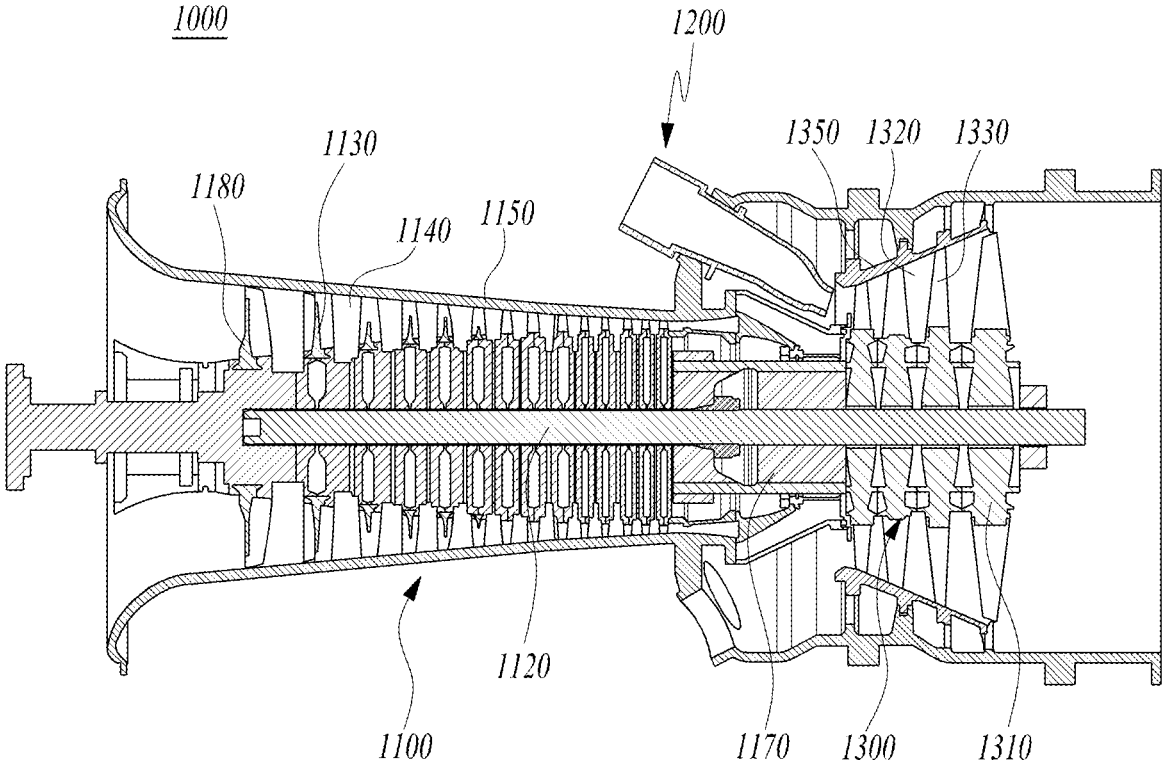
FIG. 2 is a longitudinal cross-sectional view illustrating a part of the gas turbine of FIG. 1.

FIG. 1 is a view illustrating an interior of a gas turbine according to an exemplary embodiment, and FIG. 2 is a longitudinal cross-sectional view of the gas turbine of FIG. 1.

Referring to FIGS. 1 and 2, an ideal thermodynamic cycle of a gas turbine 1000 may comply with the Brayton cycle. The Brayton cycle consists of four thermodynamic processes: an isentropic compression (i.e., an adiabatic compression) process, an isobaric combustion process, an isentropic expansion (i.e., an adiabatic expansion) process and isobaric heat ejection process. That is, in the Brayton cycle, thermal energy may be released by combustion of fuel in an isobaric environment after atmospheric air is sucked and compressed into high pressure air, hot combustion gas may be expanded to be converted into kinetic energy, and exhaust gas with residual energy may be discharged to the outside. As such, the Brayton cycle consists of four thermodynamic processes: compression, heating, expansion, and exhaust.

The gas turbine 1000 employing the Brayton cycle includes a compressor 1100, a combustor 1200, and a turbine 1300. Although the following description will be described with reference to FIG. 1, the present disclosure may be widely applied to other turbine engines similar to the gas turbine 1000 illustrated in FIG. 1.

Referring to FIG. 1, the compressor 1100 may suck and compress air. The compressor 1100 may supply the compressed air by compressor blades 1130 to a combustor 1200 and also supply cooling air to a high temperature region of the gas turbine 1000. Here, because the sucked air is compressed in the compressor 1100 through an adiabatic compression process, the pressure and temperature of the air passing through the compressor 1100 increases.

The compressor 1100 may be designed in the form of a centrifugal compressor or an axial compressor. The centrifugal compressor is applied to a small-scale gas turbine, whereas a multi-stage axial compressor is applied to a large-scale gas turbine 1000 illustrated in FIG. 1 to compress a large amount of air. In the multi-stage axial compressor 1100, the compressor blades 1130 rotate according to the rotation of a central tie rod 1120 and rotor disks, compress the introduced air and move the compressed air to the compressor vanes 1140 disposed at a following stage. The air is compressed gradually to a high pressure while passing through the compressor blades 1130 formed in multiple stages.

The compressor vanes 1140 are mounted inside a housing 1150 in such a way that a plurality of compressor vanes 1140 form each stage. The compressor vanes 1140 guide the compressed air moved from the compressor blade 1130 disposed at a preceding stage toward the compressor blade 1130 disposed at a following stage. For example, at least some of the compressor vanes 1140 may be mounted so as to be rotatable within a predetermined range, e.g., to adjust an air inflow. In addition, guide vanes 1180 may be provided in the compressor 1100 to control a flow rate of air introduced into the compressor 1100.

The compressor 1100 may be driven using a portion of the power output from the turbine 1300. To this end, as illustrated in FIG. 1, a rotary shaft of the compressor 1100 and a rotary shaft of the turbine 1300 may be directly connected by a torque tube 1170. In the case of the large-scale gas turbine 1000, almost half of the output produced by the turbine 1300 may be consumed to drive the compressor 1100.

The combustor 1200 may mix compressed air supplied from an outlet of the compressor 1100 with fuel and combust the air-fuel mixture at a constant pressure to produce a high-energy combustion gas. That is, the combustor 1200 mixes the compressed air with fuel, combusts the mixture to produce a high-temperature and high-pressure combustion gas with high energy, and increases the temperature of the combustion gas, through an isobaric combustion process, to a temperature at which the combustor and turbine parts can withstand without being thermally damaged.

The combustor 1200 may include a plurality of burners arranged in a housing formed in a cell shape and having a fuel injection nozzle, a combustor liner forming a combustion chamber, and a transition piece as a connection between the combustor and the turbine.

The high-temperature and high-pressure combustion gas ejected from the combustor 1200 is supplied to the turbine 1300. As the supplied high-temperature and high-pressure combustion gas expands, impulse and impact forces are applied to the turbine blades 1330 to generate rotational torque. A portion of the rotational torque is transferred to the compressor 1100 through the torque tube 1170, and remaining portion which is an excessive torque is used to drive a generator, or the like.

The turbine 1300 includes a rotor disk 1310, a plurality of turbine blades 1330 and turbine vanes 1320 arranged radially on the rotor disk 1310, and a ring segment 1350 disposed around the turbine blades 1330. The rotor disk 1310 has a substantially disk shape, and a plurality of grooves are formed in an outer circumferential portion thereof. The grooves are formed to have a curved surface so that the turbine blades 1330 are inserted into the grooves, and the turbine vanes 1320 are mounted in a turbine casing. The turbine blades 1330 may be coupled to the rotor disk 1310 in a manner such as a dovetail connection. The turbine vanes 1320 are fixed so as not to rotate and guide a flow direction of the combustion gas passing through the turbine blades 1330. The ring segment 1350 may be provided around the turbine blades 1330 to maintain a sealing function. A plurality of ring segments 1350 may be disposed circumferentially around the turbine 1300 to form a ring assembly.

Figure 3:
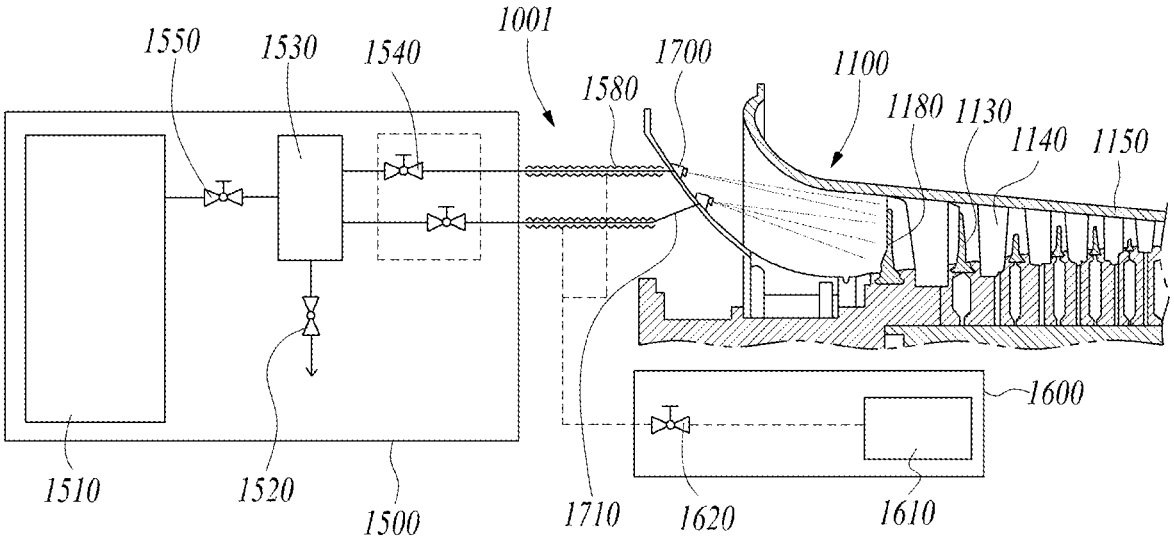
FIG. 3 is a schematic view illustrating a state in which a compressor cleaning apparatus according to the first exemplary embodiment is installed.

FIG. 3 is a schematic view illustrating a state in which a compressor cleaning apparatus according to the first exemplary embodiment is installed.

Referring to FIG. 3, the compressor cleaning apparatus 1001 may include a nozzle 1700 that injects a cleaning fluid into an interior of the compressor 1100, a fluid supply tube 1710 that is connected to the nozzle 1700 to supply the cleaning fluid to the nozzle 1700, a first cleaning fluid supply 1600 that is connected to the fluid supply tube 1710 to supply a first cleaning fluid, and a second cleaning fluid supply 1500 that is connected to the fluid supply tube 1710 to supply a second cleaning fluid.

The nozzle 1700 injects a cleaning fluid into the compressor 1100. The nozzle 1700 is configured to inject a fluid having different phases, such as a liquid phase and a gas phase. The nozzle 1700 may be a variable nozzle capable of adjusting an inner diameter according to the type of the injected fluid.

The fluid supply tube 1710 is connected to the nozzle 1700 to supply a cleaning fluid to the nozzle 1700, and a heating member 1580 for controlling the temperature of the fluid supply tube 1710 may be mounted. The heating member 1580 may include a heating wire and may be mounted to surround the fluid supply tube 1710. The heating member 1580 heats the fluid supply tube 1710 to prevent condensation of vapor in the fluid supply tube 1710 when the vapor flows in the fluid supply tube 1710.

The first cleaning fluid supply 1600 may include a water tank 1610 that stores water, a cleaning water control valve 1620 that controls a water flow, and a pump that supplies water at high pressure. Accordingly, high-pressure water may be supplied to the nozzle 1700 through the first cleaning fluid supply 1600. Water may be water at room temperature.

The second cleaning fluid supply 1500 may include a steam generator 1510 for generating steam, a steam storage 1530 for storing steam generated by the steam generator 1510, a steam control valve 1540 that controls the connection of the steam storage 1530 and the fluid supply tube 1710, a drain valve 1520 that discharges condensed water generated in the steam storage 1530, and an emergency valve 1550 that controls a flow of steam.

The steam generator 1510 may include a steam generator in a steam turbine, or an apparatus that generates steam using an auxiliary boiler that heats fuel. Here, the steam may have a temperature of 200° C. to 400° C. and a pressure of 4 to 6 bars.

The steam storage 1530 may include a high-pressure tank storing the steam generated by the steam generator 1510. The emergency valve 1550 is a check valve that shuts off a supply of steam when a malfunction or other dangerous situation occurs in the gas turbine 1000. The drain valve 1520 is connected to the steam storage 1530 to discharge condensed water condensed in the steam storage 1530. The steam control valve 1540 controls the connection of the steam storage 1530 and the fluid supply tube 1710 to supply a high-temperature and high-pressure steam to the fluid supply tube 1710.

As described above, because the compressor cleaning apparatus 1001 according to the exemplary embodiment includes the first cleaning fluid supply 1600 and the second cleaning fluid supply 1500, water and steam having different temperatures are selectively supplied to the nozzle 1700, thereby preventing icing from occurring in the compressor vanes 1140 and the compressor blades 1130 even in cold weather.

Figure 4:
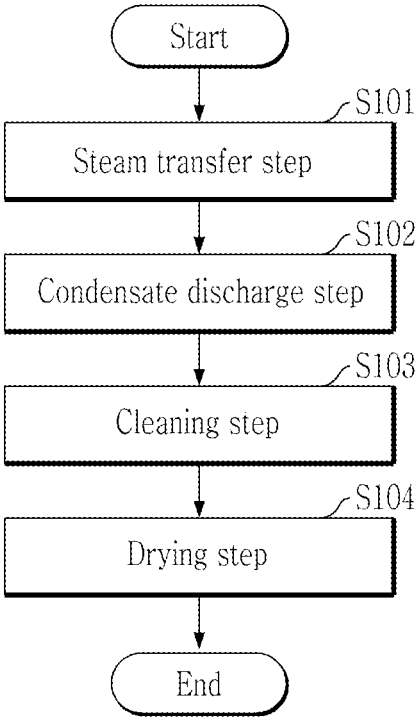
FIG. 4 is a flow chart schematically illustrating a compressor cleaning method according to the first exemplary embodiment.

Hereinafter, a compressor cleaning method according to the first exemplary embodiment will be described. FIG. 4 is a flow chart schematically illustrating a compressor cleaning method according to the first exemplary embodiment.

Referring to FIGS. 3 and 4, the compressor cleaning method may include a steam transfer step S101, a condensate discharge step S102, a cleaning step S103, and a drying step S104.

In the steam transfer step S101, the high-temperature and high-pressure steam generated by the steam generator 1510 is transferred to the steam storage 1530. In addition, the emergency valve 1550 is opened so that the steam generated by the steam generator 1510 is transferred to the steam storage 1530 to fill the steam storage 1530 with high-pressure steam.

In the condensate discharge step S102, the drain valve 1520 connected to the steam storage 1530 is opened so that the condensate is discharged until the temperature difference between the steam generator 1510 and the steam storage 1530 is within a preset range. For example, the temperature of the steam in the steam generator 1510 and the temperature of the steam in the steam storage 1530 are monitored in real time, and when the steam temperatures in the steam generator 1510 and the steam storage 1530 are within the preset range, the drain valve 1520 is opened so that the condensed water condensed in the steam storage 1530 is discharged. Here, the preset range means that the temperature difference is within 5° C. or less than 1° C.

In the cleaning step S103, the drain valve 1520 is closed and the steam control valve 1540 is opened so that steam is supplied to the nozzle 1700 and the steam is simultaneously injected to the compressor 1100 rotating at a first speed. Here, the cleaning fluid is injected toward the compressor while the compressor blades 1130 are rotated at 2 to 5 rpm.

The cleaning step S103 includes a steam injection sub-step of injecting steam and a steam filling sub-step of filling the steam storage 1530 with steam to increase the pressure of the steam storage 1530. The steam injection sub-step and the steam filling sub-step may be alternately and repeatedly performed. Accordingly, it is possible to sufficiently inject steam at high pressure in the steam injection sub-step.

In addition, in the cleaning step S103, steam may be injected while changing an inclination of a guide vane 1180 which is mounted on the inlet side of the compressor 1100 to control a flow rate of air introduced into the compressor 1100. For example, the inclination of the guide vane 1180 may be controlled to change from 50 degrees to 0 degree and then change back to 50 degrees within 1 minute. Here, 0 degree means that the inclination is parallel to a direction perpendicular to the ground.

In the drying step S104, the compressor 1100 is dried by rotating the compressor 1100 at a second speed faster than the first speed. In the drying step S104, the guide vane 1180 is adjusted at an inclination of 25 degrees with respect to the direction of gravity, and all drain valves installed in the casing of the gas turbine 1000 are opened. Here, the steam control valve 1540, the emergency valve 1550, and the cleaning water control valve 1620 are closed. The drying step S104 may be performed for 120 minutes, and the compressor 1100 may rotate at a preset driving speed. In the drying step S104, the compressor may rotate at 1000 to 5000 rpm.

Figure 5:
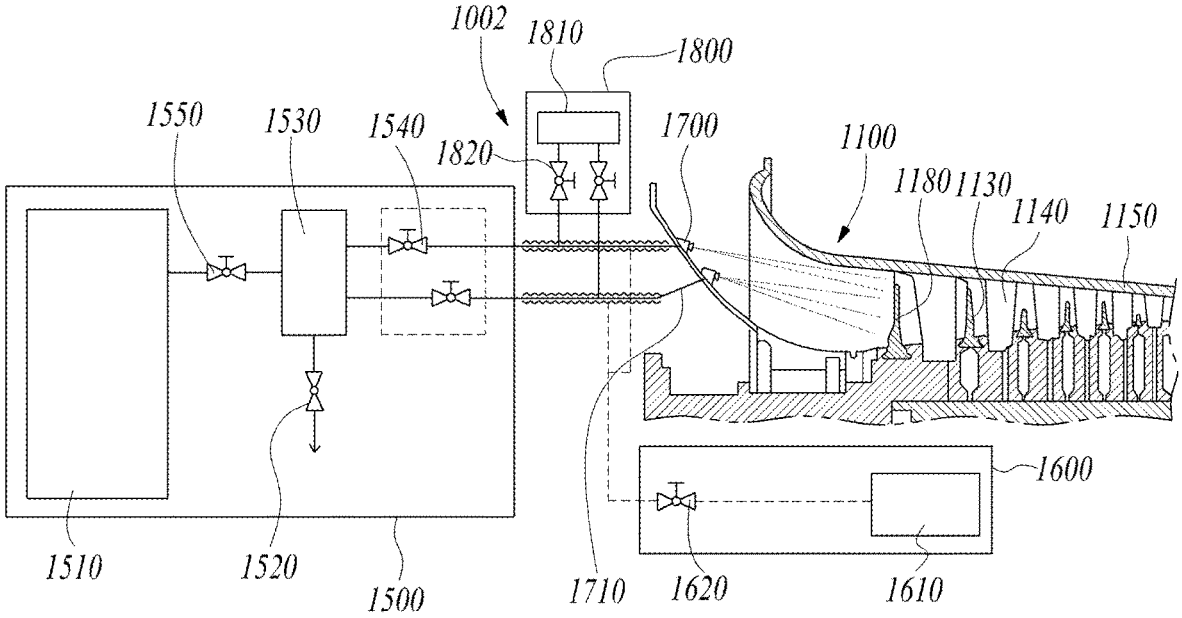
FIG. 5 is a schematic view illustrating a state in which a compressor cleaning apparatus according to a second exemplary embodiment is installed.

Hereinafter, a compressor cleaning apparatus according to a second exemplary embodiment will be described. FIG. 5 is a schematic view illustrating a state in which a compressor cleaning apparatus according to a second exemplary embodiment is installed.

Referring to FIG. 5, the compressor cleaning apparatus 1002 according to the second exemplary embodiment has the same structure as the compressor cleaning apparatus according to the first exemplary embodiment, except for a hot air supply 1800, so a redundant description for the same configuration will be omitted.

A hot air supply 1800 is connected to the fluid supply tube 1710 to supply hot air to the nozzle 1700. The hot air supply 1800 may include a hot air generator 1810 that generates hot air and a hot air control valve 1820 that controls a supply of hot air. The hot air generator 1810 may include a pump and a heater. The hot air supply 1800 is connected to the fluid supply tube 1710 to supply hot air to the interior of the compressor 1100 through the nozzle 1700, thereby preventing icing from occurring during the drying process.

The compressor cleaning method according to the second exemplary embodiment has the same structure as the compressor cleaning method according to the first exemplary embodiment, except for the drying step, so a redundant description for the same configuration will be omitted.

The compressor cleaning method according to the second exemplary embodiment includes a steam transfer step, a condensate discharge step, a cleaning step, and a drying step. In the drying step, the compressor 1100 is dried by rotating the compressor 1100 while injecting hot air through the hot air supply 1800 connected to the nozzle 1700. As described above, according to the second exemplary embodiment, the compressor 1100 is rotated while the hot air is injected, it is possible to prevent icing from occurring during the drying process.

Figure 6:
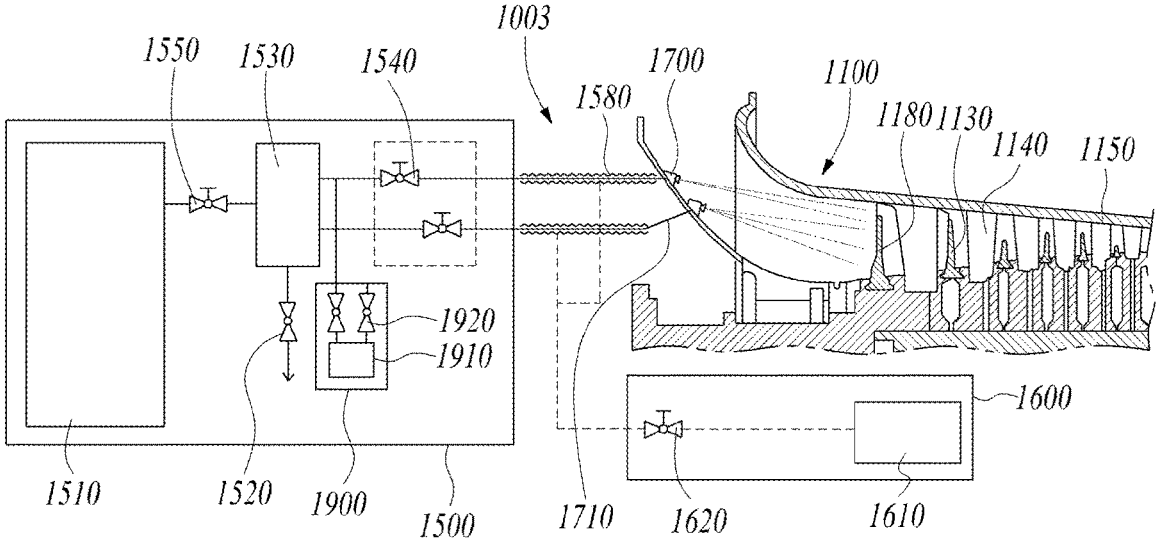
FIG. 6 is a schematic view illustrating a state in which a compressor cleaning apparatus according to a third exemplary embodiment is installed.

Hereinafter, a compressor cleaning apparatus according to a third exemplary embodiment will be described. FIG. 6 is a schematic view illustrating a state in which a compressor cleaning apparatus according to a third exemplary embodiment is installed.

Referring to FIG. 6, the compressor cleaning apparatus 1003 according to the third exemplary embodiment has the same structure as the compressor cleaning apparatus according to the first exemplary embodiment, except for an antifreeze supply 1900, so a redundant description for the same configuration will be omitted.

The second cleaning fluid supply 1500 according to the third exemplary embodiment further includes an antifreeze supply 1900 that is connected to a steam supply line to supply an antifreeze agent that lowers the freezing point of water to the steam. The antifreeze supply 1900 may include an antifreeze tank 1910 that stores the antifreeze agent and an antifreeze control valve 1920 that controls a supply of the antifreeze agent.

The antifreeze agent is a material that is mixed with steam to lower the freezing point and may include various kinds of materials. The antifreeze agent may be formed of a liquid substance or powders. However, the antifreeze agent may consist of materials that do not cause corrosion. For example, the antifreeze agent may be made of alcohol, glycol, or the like.

The antifreeze supply 1900 may supply the antifreeze agent to the interior of the compressor 1100 together with steam after cleaning is completed, thereby preventing icing from occurring during the drying process.

The compressor cleaning method according to the third exemplary embodiment has the same structure as the compressor cleaning method according to the first exemplary embodiment, except for the drying step, so a redundant description for the same configuration will be omitted.

The compressor cleaning method according to the third exemplary embodiment includes a steam transfer step, a condensate discharge step, a cleaning step, and a drying step. In the drying step, the compressor 1100 is dried by rotating the compressor 1100 after injecting the antifreeze agent to the nozzle 1700 together with the steam. As described above, according to the third exemplary embodiment, the antifreeze agent is supplied together with steam, thereby preventing icing from occurring during the drying process.

While one or more exemplary embodiments have been described with reference to the accompanying drawings, it will be apparent to those skilled in the art that various modifications and variations can be made through addition, change, omission, or substitution of components without departing from the spirit and scope of the disclosure as set forth in the appended claims, and these modifications and changes fall within the spirit and scope of the disclosure as defined in the appended claims.

What is claimed is:

1. A compressor cleaning apparatus comprising:

a nozzle configured to inject a cleaning fluid into an interior of a compressor of a gas turbine;

a fluid supply tube connected to the nozzle to supply the cleaning fluid to the nozzle;

a first cleaning fluid supply connected to the fluid supply tube to supply a first cleaning fluid; and a second cleaning fluid supply connected to the fluid supply tube to supply a second cleaning fluid having a temperature higher than that of the first cleaning fluid, wherein the second cleaning fluid supply includes a steam generator configured to generate steam and the second cleaning fluid includes the steam generated by the steam generator.

2. The compressor cleaning apparatus according to claim 1, wherein the first cleaning fluid includes water.

3. The compressor cleaning apparatus according to claim 1, wherein the temperature of the first cleaning fluid is at room temperature, and the temperature of the second cleaning fluid is 200° C. to 400° C.

4. The compressor cleaning apparatus according to claim 1, wherein the second cleaning fluid supply further includes a steam storage configured to store the steam generated by the steam generator, a steam control valve configured to control a connection of the steam storage and the fluid supply tube, and a drain valve configured to discharge a condensed water generated in the steam storage.

5. The compressor cleaning apparatus according to claim 1, wherein a hot air supply is connected to the fluid supply tube to supply hot air to the nozzle.

6. The compressor cleaning apparatus according to claim 1, wherein the second cleaning fluid supply further includes an antifreeze supply connected to a steam supply line to supply an antifreeze agent that lowers a freezing point of water to the steam.

7. The compressor cleaning apparatus according to claim 1, wherein a heating member is provided to the fluid supply tube to control a temperature of the fluid supply tube.

8. A gas turbine, having a compressor cleaning apparatus, comprising:

a compressor configured to compress air introduced from an outside, a combustor configured to mix the air compressed by the compressor with fuel and combust an air-fuel mixture, a turbine having a plurality of turbine blades configured to be rotated by the combustion gas discharged from the combustor, and the compressor cleaning apparatus configured to inject a cleaning fluid to compressor blades to clean the compressor, the compressor cleaning apparatus comprising:

a nozzle, coupled with the compressor, configured to inject the cleaning fluid into an interior of the compressor;

a fluid supply tube connected to the nozzle to supply the cleaning fluid to the nozzle;

a first cleaning fluid supply connected to the fluid supply tube to supply a first cleaning fluid; and a second cleaning fluid supply connected to the fluid supply tube to supply a second cleaning fluid having a temperature higher than that of the first cleaning fluid, wherein the second cleaning fluid supply includes a steam generator configured to generate steam and the second cleaning fluid includes the steam generated by the steam generator.

9. The gas turbine according to claim 8, wherein the first cleaning fluid includes water.

10. The gas turbine according to claim 8, wherein the temperature of the first cleaning fluid is at room temperature, and the temperature of the second cleaning fluid is 200° C. to 400° C.

11. The gas turbine according to claim 8, wherein the second cleaning fluid supply further includes a steam storage configured to store the steam generated by the steam generator, a steam control valve configured to control the connection of the steam storage and the fluid supply tube, and a drain valve configured to discharge a condensed water generated in the steam storage.

12. The gas turbine according to claim 8, wherein a hot air supply is connected to the fluid supply tube to supply hot air to the nozzle.

13. The gas turbine according to claim 8, wherein the second cleaning fluid supply further includes an antifreeze supply connected to a steam supply line to supply an antifreeze agent that lowers a freezing point of water to the steam.

14. The gas turbine according to claim 8, wherein a heating member is provided to the fluid supply tube to control a temperature of the fluid supply tube.

15. The compressor cleaning apparatus according to claim 5, wherein the hot air supply comprises a hot air generator that generates the hot air and a hot air control valve that controls a supply of the hot air.

16. The compressor cleaning apparatus according to claim 15, wherein the hot air generator includes a pump and a heater.

17. The compressor cleaning apparatus according to claim 6, wherein the antifreeze supply includes an antifreeze tank that stores the antifreeze agent and an antifreeze control valve that controls a supply of the antifreeze agent.

18. The compressor cleaning apparatus according to claim 17, wherein the antifreeze agent is formed of a liquid substance or powders.

19. The compressor cleaning apparatus according to claim 17, wherein the antifreeze agent is made of at least one of alcohol and glycol.

20. The compressor cleaning apparatus according to claim 7, wherein the heating member includes a heating wire and is mounted to surround the fluid supply tube.

* * * * *